US005620102A

United States Patent [19]

Finch, Jr.

[11] Patent Number: 5,620,102

[45] Date of Patent: Apr. 15, 1997

[54] CONVEYOR SORTING SYSTEM FOR PACKAGES

[76] Inventor: Walter F. Finch, Jr., 31 Churchill Rd., Brockton, Mass. 02401

[21] Appl. No.: 392,032

[22] Filed: Feb. 22, 1995

[51] Int. Cl.[6] ..... B07C 5/00

[52] U.S. Cl. ..... 209/583; 209/584; 209/630; 209/653; 209/705; 209/942

[58] Field of Search ..... 209/583, 584, 209/702, 705, 559, 653, 942, 630

[56] References Cited

U.S. PATENT DOCUMENTS 3,642,117 2/1972 Burt ..... 209/583 X 3,955,678 5/1976 Moyer ..... 209/583 X

*Primary Examiner*—David H. Bollinger

*Attorney, Agent, or Firm*—Bookstein & Kudirka, P.C.

[57] ABSTRACT

A method and apparatus are provided for directing a parcel to a correct station from a conveyer. A parcel guide is actuated to move transversely across the conveyer adjacent the correct station.

14 Claims, 6 Drawing Sheets

CONVEYOR SORTING SYSTEM FOR PACKAGES

BACKGROUND OF THE INVENTION

This invention relates to a parcel sorting system and more particularly to a parcel sorting system wherein a package is transported to and deposited into a designated container.

At the present time, articles are sorted by categories by being transferred along a conveying apparatus past laborers who selectively remove the articles from the conveyer based upon the category displayed by the article. A typical article category would be the address zip code borne by a mailed article. The present procedure is labor intensive and therefore, expensive.

Automatic transfer mechanisms are known in the art which utilize a conveyor system and wherein a plurality of conveyors are positioned transverse to each other in order to provide a means for effecting a change of direction of a package travelling on the conveyor system. Generally, these conveyor systems are provided with means for independently powering each conveyer or with a sole powering means for powering two adjacent conveyors. An example of the latter system is disclosed, for example, in U.S. Pat. No. 4,962,841. Other apparatus provide a powered roller conveyor with rollers spaced apart a small distance so that small packages can be directed downwardly between rollers. Such a system is disclosed for example in U.S. Pat. No. 5,186,336. This system is limited since it is not useful for medium size or large size packages.

In other systems, means are provided for lifting packages from a powered conveyor in order to deposit them in designated bins. Such systems are complicated and expensive since mechanical movement of the lifting apparatus in three dimensions is required.

Accordingly, it would be desirable to provide a parcel sorting system which eliminates the need for labor as a lifting apparatus to remove a parcel from a conveyor. It would also be desirable to provide such a system wherein parcel removal from a conveyer at a designated station or bin can be effected automatically. In addition, it would be desirable to provide such a system wherein parcel removal from a conveyor at a designated station can be effected automatically regardless of a position of the parcel along the width of the conveyor.

SUMMARY OF THE INVENTION

The present invention provides a parcel sorting method and system which utilizes a conveyor to transfer parcels, a plurality of slideably mounted parcel guides, means for determining a position of a parcel on the conveyor and means for automatically activating the parcel guides as a function of parcel position in order to place a parcel in a correct container. The conveyor comprises a conventional conveyer such as a belt or a plurality of powered, spaced apart rollers lying substantially in a common plane. The parcel guides are slideably mounted on one or more guide rails. Each parcel is assigned an identification code in order that it can be finally positioned in the correct container. The position of each parcel on the conveyor is sensed and when the correct position of the parcel relative to the correct container is determined, the correct parcel guide is activated in order to direct the correct parcel into the correct container. The correct parcel guide is activated automatically when the parcel is in the correct position relative to the correct container. In a preferred embodiment of this invention, a parcel guide is provided which is capable of guiding a parcel across the width of the conveyor regardless of the position of the parcel along the width of the conveyor.

DESCRIPTION OF SPECIFIC EMBODIMENTS

In accordance with this invention, a parcel sorting system is provided which utilizes a main conveyor comprising powered rollers, a parcel guiding apparatus to direct parcels from the conveyor to a designated container and a control system which assures that each parcel is directed to a correct station such as a second conveyor positioned transverse the main conveyor or into a correct container. For convenience, this invention will be described herein with reference to the use of containers at the stations. The conveyor can comprise any conventional conveyor such as a belted conveyer or a plurality of powered rollers which are spaced apart a short distance from each other. When a conveyer utilizing a plurality of powered rollers is utilized, the conveyer can include passive rollers so long as there is a short distance between powered rollers to assure that parcels do not become stopped on the conveyor.

The parcel guiding apparatus is configured to be movable across the width of the conveyor at a suitable time to effect deposition of a parcel into a desired station, e.g., container. The parcel guide includes a plate or the like mounted on rails or a rail. Each rail is positioned between adjacent rollers of the conveyor in the case of the powered roller conveyer. When using a belted conveyer or the like, the supporting rails for the parcel guide are positioned above the conveyer so that the rails do not interfere with the movement of the conveyer. The plate is activated to move along the rails by a solenoid or the like to move along the rails across the width of the conveyor.

The control system is configured to control the introduction of individual parcels to the conveyor system so that the system is capable of recognizing the position of the parcel on the conveyor relative to the correct container into which it is to be deposited. The parcels are deposited seriatim onto the conveyor and are labeled by code prior to being deposited onto the conveyor. Means are provided adjacent each parcel container to identify the introduction and exit of a labeled parcel to and from the parcel guide position associated with each container. The information associated with each of these identification events is communicated to each identification means associated with each container. When the correct parcel is located within the area of the container into which the parcel is to be deposited, the control system activates the parcel guide associated with the container in order to move the parcel from the conveyor into the container. After the parcel has been deposited into the container, the parcel guide is repositioned to a set position to permit it to move a subsequent parcel into the correct container.

This invention will be described further with reference to the accompanying drawings.

Figure 1:
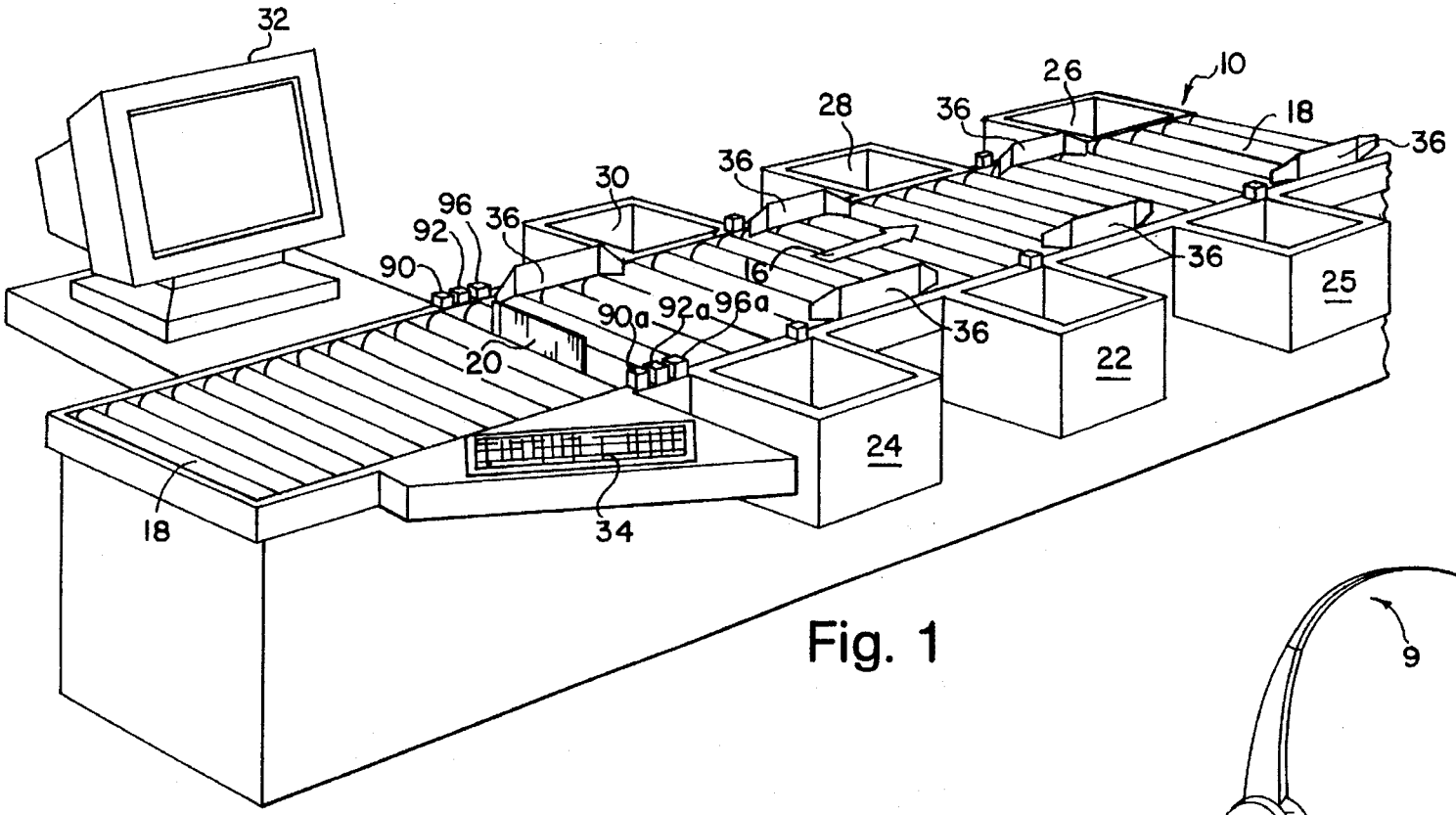
FIG. 1 is a perspective view of the apparatus of this invention.

Referring to FIG. 1, the parcel sorting apparatus 10 of this invention comprises a conveyer such as a powered roller conveyer 12 including a plurality of spaced apart powered rollers 14 which are powered by any conventional means (not shown). The roller conveyor 12 effects movement of parcels in the direction of arrow 16. A feeder roller conveyor 18 is provided which may or may not be powered. A stop gate 20 is provided in order to permit entry of the package information into the system. Exemplary information comprises the code to which a parcel is being sent which, according to the system, is correlated to a specific container 22, 24, 25, 26, 28 or 30 for the parcel. The information is input into computer 32 by means of keyboard 34. Any conventional input apparatus can be utilized rather than a keyboard such as a scanner, voice input device or the like. The apparatus 10 is provided with a plurality of parcel guiding apparatus (plates) 36, each positioned to direct a parcel into one container, 22, 24, 25, 26, 28 or 30. The parcel guiding apparatus 36 are mounted on rails (See FIG. 2) so that they can move in a direction parallel to the length of the rollers 14 and across the width of the conveyor 12. A photocell consisting of a photobeam generator 90 and photobeam receiver 90A senses the presence of a package when the photbeam generated is interrupted. A photocell consisting of photobeam generator 92 and photobeam receiver 92A senses the presence of a package downstream of stop gate 20. A photocell consisting of photobeam generator 96 and photobeam receiver 96A is used to track a package position. The operation of these photocells is described more fully below.

Figure 1A:
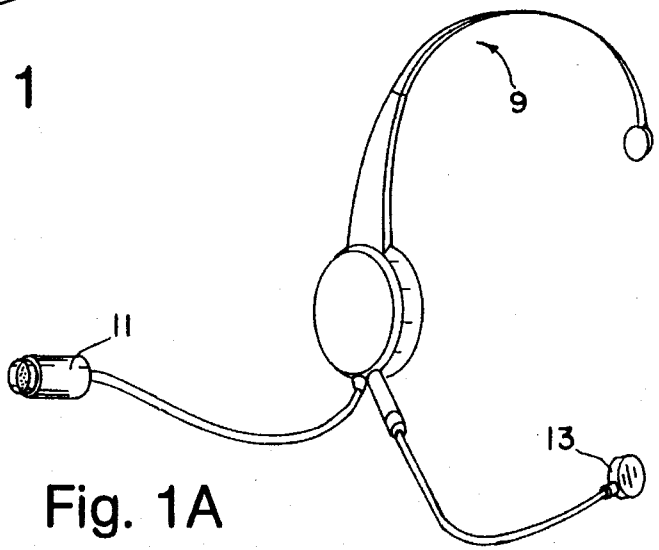

Referring to FIG. 1A, a conventional voice input device 9 is shown comprising a plug 11 to plug it into a conventional computer sound card, a microphone 13 and a head set 15 to fit the voice input device 9 onto the head of a user.

Figure 2:
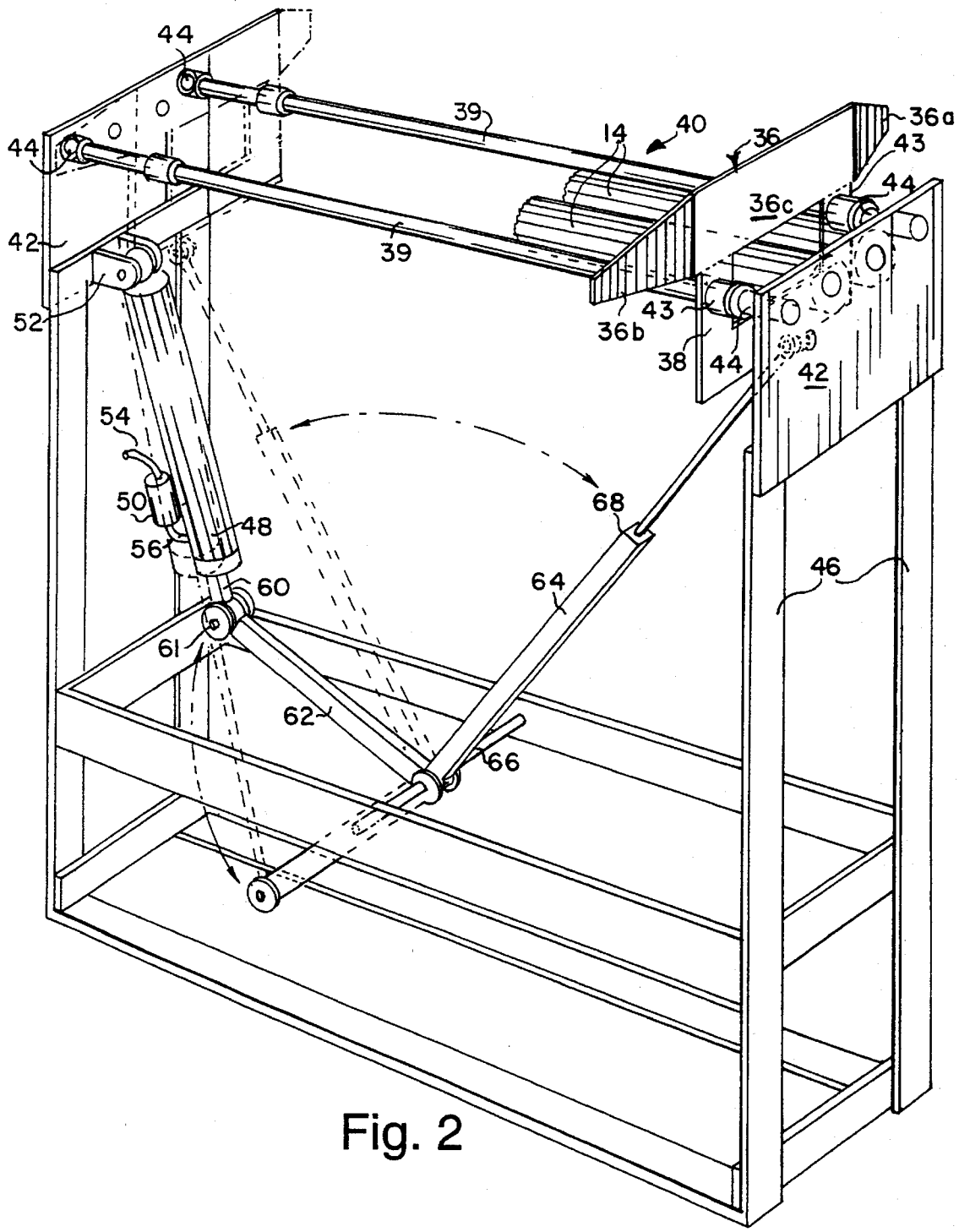
FIG. 2 is a side view of a parcel guide used in the apparatus of this invention.

Referring to FIG. 2, the parcel guiding means 40 is shown. A plate 36 is mounted on bracket 38. The bracket 38 has two holes through which rails 39 are passed. Rails 39 are mounted on end plates 42 and are positioned between rollers 14 of the conveyor 12 which are shown in dotted lines. Rails 39 also are passed through two block bearings 43 which, in turn, are mounted on bracket 38. Block cushions 44 are positioned on rails 39 adjacent end plates 42 and cooperate with the block bearing 43 and bracket 38 to define the length which plate 36 travels along rails 39. The end plates 42 are mounted on frame 46.

A gas cylinder 48 which is activated by solenoid 50 is mounted on end plate 42 by bracket 52. Solenoid 50 controls gas flow from gas supply base 54 and into hose 56 connected to air cylinder 48. Any conventional activating means can be utilized rather than an air cylinder such as a hydraulic cylinder or a spring means. Solenoid 50 also activates a gas outlet (not shown) within the cylinder 50 causing the plate 36 to reverse direction on the rails 39. Cylinder 48 is connected to plate 36 by rod 60 and slide lever 64. Slide lever 64 is pivotally mounted on shaft 66 while rod 60 is pivotally mounted on slide lever 64 with shaft 61. Slide lever 64 is connected to plate 36 by block bearing 68. When solenoid 50 is activated, plate 36 is caused to move by sliding along rails 39 between both sets of block cushions 44.

The structure of rod 60 on shaft 61 and slide lever 64 on shaft 66 permits operation of the parcel guide means 40 within the width defined by the conveyor 12. This feature provides improved safety when operating the system since no portion of moving apparatus extends beyond the conveyor 12.

The plate 36 of FIG. 2 Includes two wing sections, 36A and 36B which function as a guide to slide the parcel onto plate section 36C. When the parcel contacts plate section 36C it is at the proper position, to be moved across the conveyor. Thus, the plate 36, as configured in FIG. 2 is capable of properly positioning the parcel for movement across the conveyor 12, regardless of the initial parcel position within the width of the conveyor 12.

Figure 3:
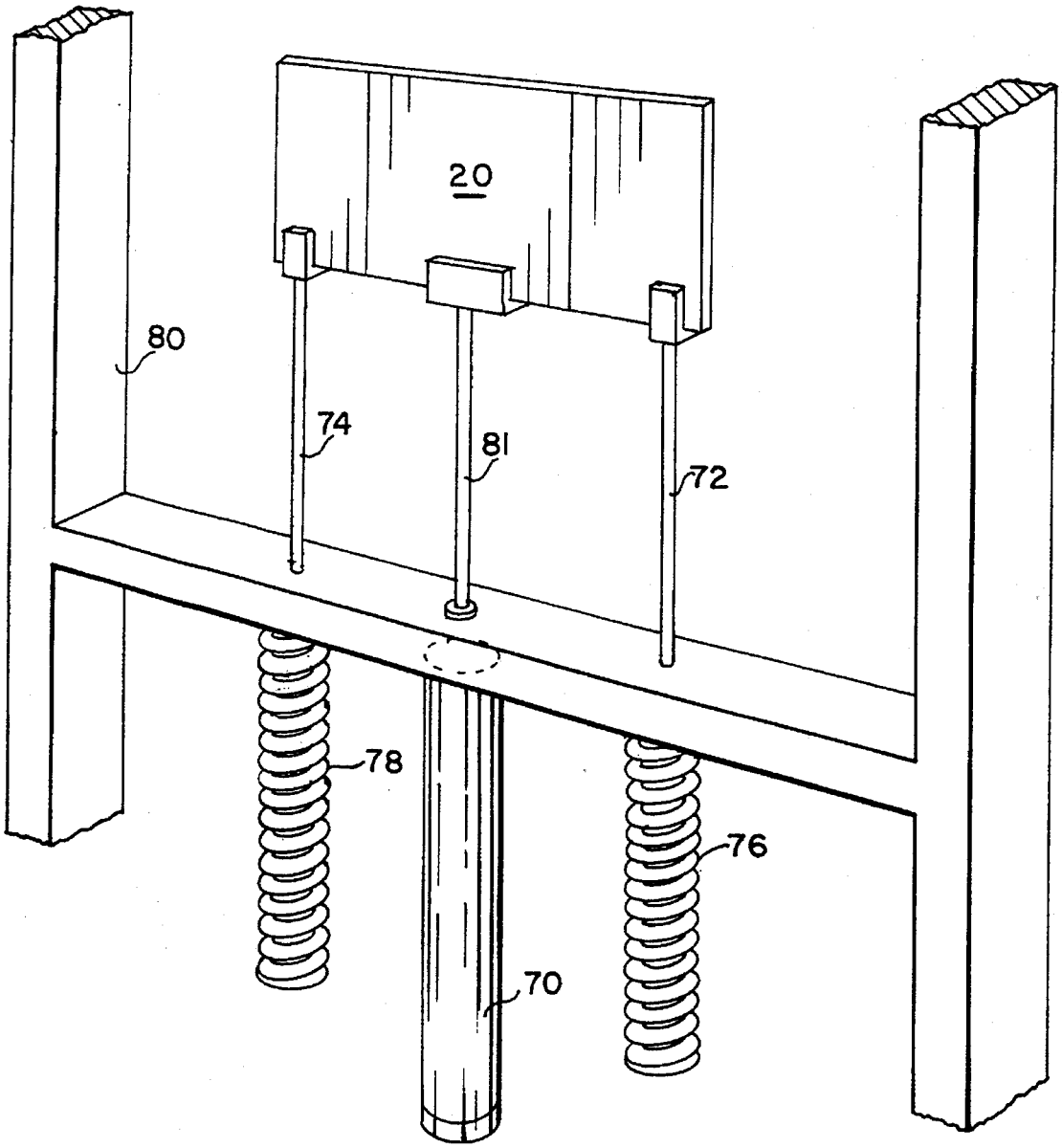
FIG. 3 is a perspective view of a stop gate assembly used in the apparatus of this invention.

Referring to FIG. 3, the stop gate 20 is mounted on air cylinder 70 which functions to raise and lower stop gate 20 in any conventional manner such as by being controlled by a solenoid (not shown). Shafts 72 and 74 pass through block bearings 76 and 78 and extend through frame 80. When the solenoid energizes, it pressurizes the cylinder 70 pulling down on rod 81. The stop gate 20 is pulled down and is guided by rods 72 and 74. When pressure is released, it is sprung up by the internal spring in the cylinder.

Figure 4:
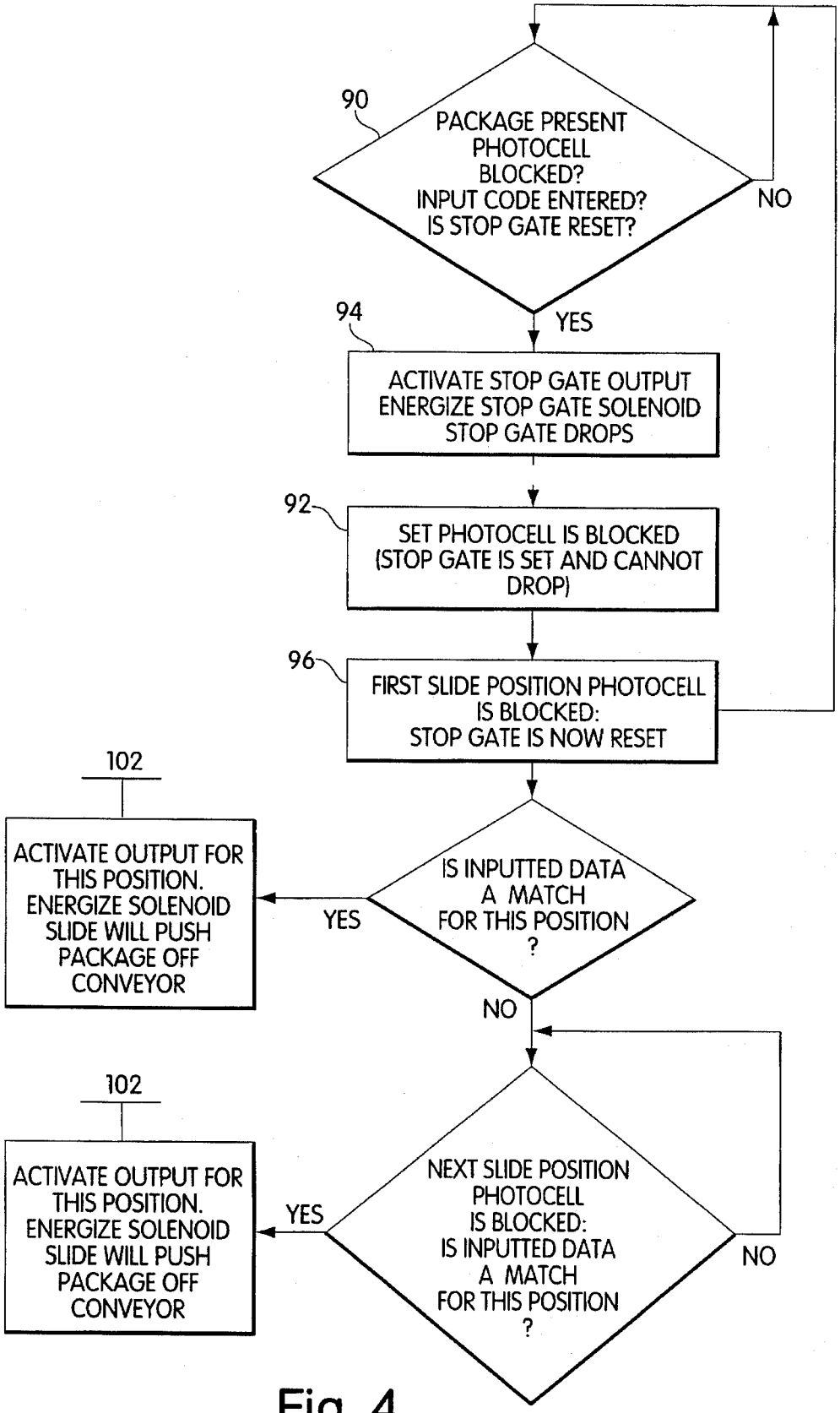
FIG. 4 is a block diagram of a control system of this invention.

Referring to FIG. 4, the routine system of this invention is illustrated. When a photocell 90 positioned parallel to stop gate 20 is blocked, a signal is sent to a conventional computer 32 to show that a parcel is present at the stop gate 20. Photocells are arranged so that a photobeam generator is positioned on a first side of the conveyor while a receiver is positioned on the side of the conveyor opposite the side. If a package is present, the operator (keyer) enters a code for the package into the computer 32. Once these are accomplished and the gate is reset, the stop gate 20 will drop and allow the parcel onto the sort side of the conveyer. A signal also is sent to the computer 32 by photocell 92 located downstream from stop gate 20 on the conveyor 12. When photocell 92 is blocked by a parcel on the conveyer 12 a signal is sent to computer 32 which prevents the stop gate from dropping. The package will move down conveyer to the first parcel guide photocell 96. A signal will reset the stop gate, so if the package present photocell is blocked and a code has been entered, the stop gate 20 will again drop, allowing another package onto the sort side of the conveyer. A signal from photocell 96 will also be sent to the computer 32 in order to effect tracking of the parcel by matching the parcel position with the parcel code input 100. When the computer 32 has determined that the parcel has reached the correct container, a signal 102 from the computer 32 activates the solenoid of the correct parcel guide so that the parcel guide is moved across the width of conveyor 12 and it pushes the parcel into the correct container 22, 24, 25, 26, 28 or 30.

Figure 5:
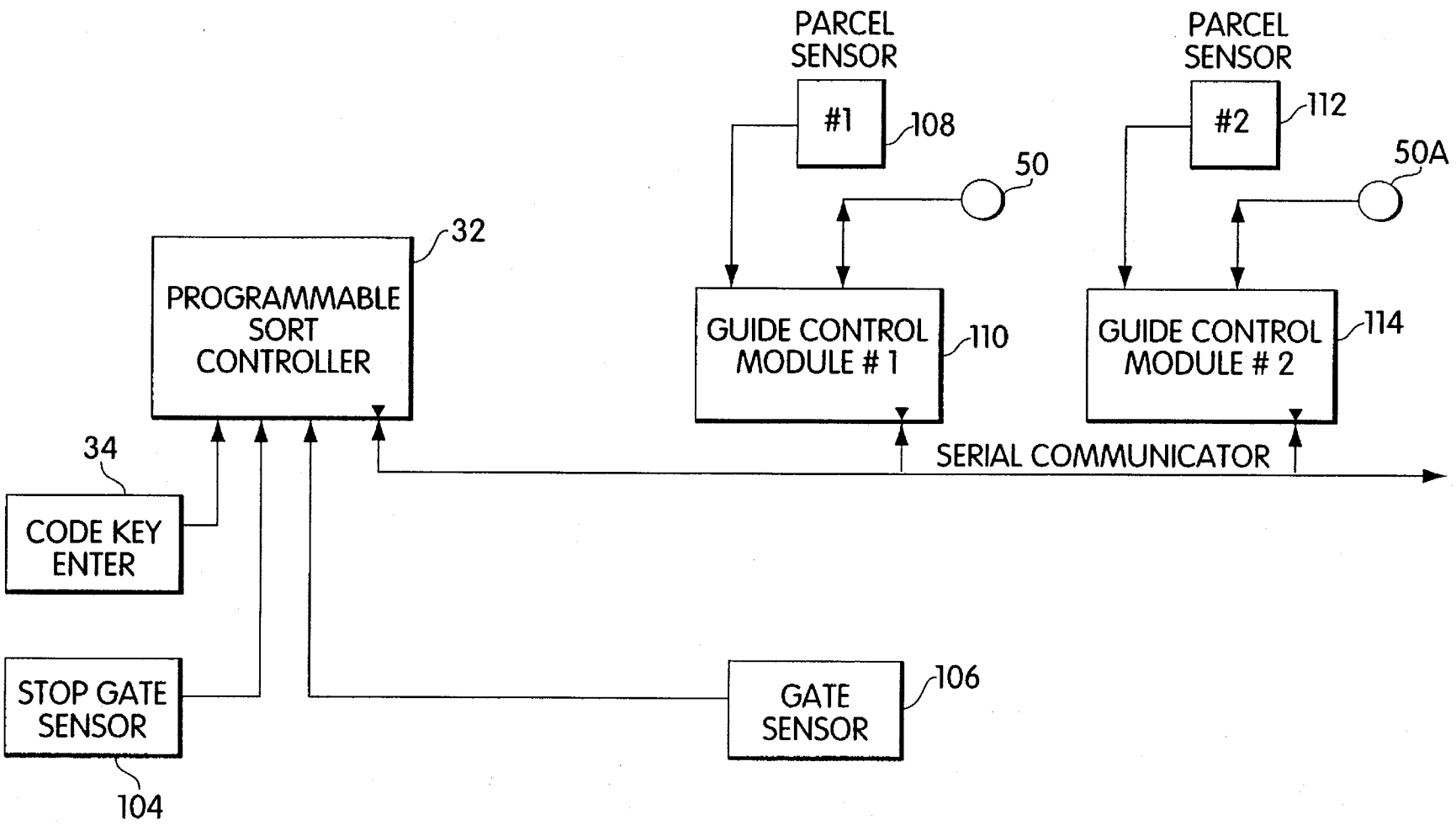
FIG. 5 is a flow chart illustrating a portion of a control program which detects the leading and trailing edge of a parcel.

Referring to FIG. 5, photocell 104 supplies an input signal to computer 32 from the stop gate position. Photocell 106 supplies an input signal to computer 32 from a location downstream of the stop gate 20 on conveyor 12. Keyboard 34 provides an input to computer 32, usually from an operator who can determine information from a parcel resting at the stop gate 20. An input signal is provided to computer 32 by parcel sensor 108 comprising a photocell arrangement with a reflector to indicate the presence or absence of a parcel positioned at guide control module 110 on conveyor 12 and to reset stop gate 20. An input signal also is provided to computer 32 by parcel sensor 112 to indicate the presence or absence of a parcel positioned at guide control module 114 on conveyor 12. Computer 32 provides an input signal to each of guide control modules 110 and 114 in order to activate solenoids 50 and 50A respectively when a parcel positioned at guide control module 110 or guide control 114 is to be pushed from conveyor 12 into container 22 or 24. Additional guide control modules with associated parcel sensors and solenoids can be added as desired.

Figure 6:
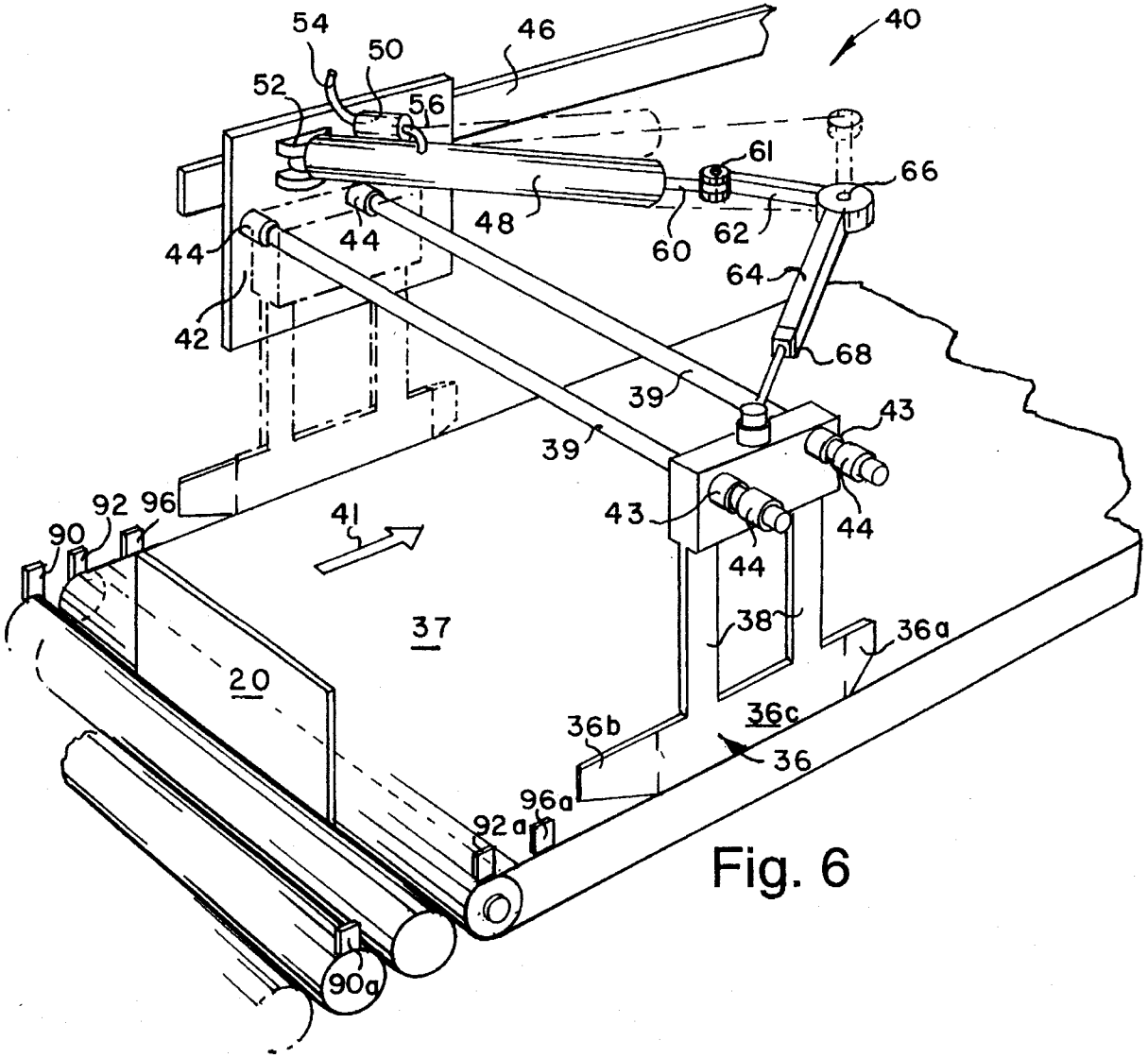
FIG. 6 is a side view of a parcel guide utilized in conjunction with a belt conveyor.

Referring to FIG. 6, an embodiment of this invention is shown wherein the activation means is positioned above a conveyer when utilizing a belt conveyer. In FIG. 6, like elements of FIG. 2 are shown by the same reference numerals.

The bracket 38 has two holes through which rails 39 are passed. Rails 39 are mounted on end plates 42 and are positioned above belt conveyor 37 which is travelling in direction 41. Rails 39 also are passed through two block bearings 43 which, in turn, are mounted on bracket 38. Block cushions 44 are positioned on rails 39 adjacent end plates 42 and cooperate with the block bearings 43 and bracket 38 to define the length which plate 36 travels along rails 39. The end plates 42 are mounted on frame 46.

A gas cylinder 48 which is activated by solenoid 50 is mounted on end plate 42 by bracket 52. End plates 42 are mounted on elevated frame 43 above belt conveyer 37. Solenoid 50 controls gas flow from gas supply base 54 and into hose 56 connected to air cylinder 48. Solenoid 50 also activates a gas outlet (not shown) within the cylinder 50 causing the plate 36 to reverse direction on the rails 39. Cylinder 48 is connected to plate 36 by rod 60 and slide lever 64. Slide lever 64 is pivotally mounted on shaft 66 while rod 60 is pivotally mounted on slide lever 62 with shaft 61. Slide lever 64 is connected to plate 36 by block bearing 68. When solenoid 50 is activated, plate 36 is caused to move by sliding along rails 39 between both sets of block cushions 44.

The structure of rod 60 on shaft 61 and slide lever 64 on shaft 66 permits operation of the parcel guide means 40 within the width defined by the conveyor 37. This feature provides improved safety when operating the system since no portion of moving apparatus extends beyond the conveyor 37.

The plate 36 of FIG. 6 Includes two wing sections, 36A and 36B which function as a guide to slide the parcel onto plate section 36C. When the parcel contacts plate section 36C it is at the proper position to be moved across the conveyor. Thus, the plate 36, as configured in FIG. 6 is capable of properly positioning the parcel for movement across the conveyor 37, regardless of the initial parcel position within the width of the conveyor 37.

I claim:

1. A method for directing a parcel to a correct station from a powered conveyor which comprises:

a first step of identifying an identification characteristic of a parcel positioned adjacent a parcel stop means, said stop means being positioned adjacent an entrance to said conveyor, a second step of identifying a presence of said parcel at said stop means, moving said stop means to permit said parcel to enter said conveyor in response to said first and second steps of identifying, moving said parcel along said conveyor to sensor means which sense a position of said parcel on said conveyor, determining a correct position of said parcel on said conveyor in response to said sensor means, and activating an activating means to move said parcel across at least a portion of the width of said conveyor to said correct station in response to determining said correct position of said parcel.

2. The method of claim 1 wherein said first step of identifying an identification characteristic of a parcel comprises generating an input from a keyboard.

3. The method of claim 1 wherein said first step of identifying an identification characteristic of a parcel comprises scanning a code on said parcel.

4. The method of claim 1 wherein said first step of identifying an identification characteristic of a parcel comprises a voice activation means.

5. The method of claim 1 wherein a plurality of parcels are caused to enter said conveyor seriatim and wherein a correct position of each parcel on said conveyor is determined.

6. The method of claim 1 wherein said activating means is confined within a volume having one dimension comprising the width of said conveyor during said activating step.

7. Apparatus for directing a parcel to a correct station from a conveyor which comprises:

a powered conveyor a stop means adjacent an entrance to said conveyor for stopping said parcel, first identifying means for identifying presence of a parcel adjacent said stop means, second identifying means for identifying an identification characteristic of said parcel, means for moving said stop means in response to said first identifying means and said second identifying means to permit said parcel to enter said conveyor, a plurality of stations configured to receive a parcel from said conveyor, sensor means for determining a correct position of said parcel on said conveyor, and activating means for moving said parcel across at least a portion of the width of said conveyor to said correct station in response to said sensor means determining said correct position of said parcel on said conveyor.

8. The apparatus of claim 7 wherein said activating means comprises a plate means mounted on activatable levers.

9. The apparatus of claim 8 wherein said plate includes a plate section extending from a mid-section of said plate away from a mid-section of said conveyer.

10. The apparatus of claim 9 wherein said levers are confined within a volume having one dimension comprising the width of said conveyor when said levers are activated and when said levers are at rest.

11. The apparatus of claim 8, wherein said levers are confined within a volume having one dimension comprising the width of said conveyor when said levers are activated and when said levers are at rest.

12. The apparatus of any one of claims 7, 8, 9, 11, or 10 wherein said powered conveyor is a powered roller conveyor.

13. The apparatus of any one of claims 7, 8, 9, 11 or 10 wherein said powered conveyor is a belt conveyor.

14. The apparatus of claim 7 wherein said activating means for moving said parcel across at least a portion of the width of said conveyor to said correct station is confined within a volume having one dimension comprising the width of said conveyor when said activating means is activated and when said activating means is inactive.

* * * * *